US007675531B2

(12) United States Patent
Mikami et al.

(10) Patent No.: US 7,675,531 B2
(45) Date of Patent: Mar. 9, 2010

(54) IMAGE FORMING APPARATUS

(75) Inventors: Masato Mikami, Saitama (JP); Kunihiro Maie, Saitama (JP); Kouji Tsutsumi, Saitama (JP); Shingo Yano, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 417 days.

(21) Appl. No.: 11/349,945

(22) Filed: Feb. 9, 2006

(65) Prior Publication Data

US 2007/0070166 A1 Mar. 29, 2007

(30) Foreign Application Priority Data

Sep. 26, 2005 (JP) ..... P.2005-277978

(51) Int. Cl.
*B41J 2/385* (2006.01)

(52) U.S. Cl. ..... 347/130

(58) Field of Classification Search ..... None
See application file for complete search history.

(56) References Cited

U.S. PATENT DOCUMENTS 5,630,027 A * 5/1997 Venkateswar et al. ..... 358/1.8
5,825,400 A * 10/1998 Florence ..... 347/239
6,525,752 B2 * 2/2003 Vackier et al. ..... 347/130
6,825,862 B2 * 11/2004 Tokunaga ..... 347/116
6,864,908 B2 * 3/2005 Corona et al. ..... 347/238
2004/0141050 A1 * 7/2004 Corona et al. ..... 347/238

FOREIGN PATENT DOCUMENTS

JP 6-255175 A 9/1994
JP 6-258727 A 9/1994

* cited by examiner

*Primary Examiner*—Stephen D Meier
*Assistant Examiner*—Alexander C Witkowski
(74) *Attorney, Agent, or Firm*—Sughrue Mion, PLLC

(57) ABSTRACT

An image forming apparatus capable of forming wide images, includes: an exposing unit having a plurality of LED (light-emitting diode) heads arranged alternately in a main scanning direction, in which the resolution of an LED row formed in at least one of the plurality of LED heads is higher than the resolution of image data in a main scanning direction; and a lighting control unit that controls to turn on or turn off dots in the LED row such that the exposing position of a photoconductive drum is moved in the unit of dots of the high resolution LED row.

12 Claims, 6 Drawing Sheets

IMAGE FORMING APPARATUS

BACKGROUND OF THE INVENTION

1. Field of the Invention

The present invention relates to improvement on an image forming apparatus that is capable of forming wide images.

2. Background Art

An image bar used for wide exposure so as to form wide images, such as A0 size or A1 size, is not general and thus its device is very expensive. Consequently, some techniques have been proposed to arrange a plurality of A3 or A4 size image bars, which are generally used, to conduct the wide exposure.

For example, JP-A-6-258727 discloses an apparatus that is capable of conducting an exposure on a photoconductor in a direct line by arranging a plurality of image bars included in a liquid crystal structure.

Also, JP-A-6-255175 discloses an example of a plurality of LED (light-emitting diode) heads arranged in a zigzag pattern.

However, the above-mentioned techniques according to the related arts, it is difficult to determine with a high precision the positional relationship of the overlapping portions of the image bars or LED heads arranged in a zigzag pattern, i.e., the dots formed at the end portions in each of the image bars or the LED heads. In such case, if the dots at the end portions are overlapped with each other, black streaks appear in the printed images. If the dots at the end portions are deviated and thus gaps exist between them, white streaks appear on the printed images.

Furthermore, in CAD (computer aided design) drawings, the original dimensions of the drawn objects are often required to be maintained in the drawings. However, the resolution of the LED is generally denoted as the number of dots per inch (dpi). Meanwhile, since the meter system has been used as the unit in Japan when the LED heads are manufactured, there are problems that dimensional errors may occur as much as the fractional number generated at the time of unit conversion. The dimensional errors become conspicuous as the size of the LED heads become larger. Also, a paper may be shrunk by heating the paper when fixing the toner images on the paper and the shrunk paper may cause the dimensional errors, which is also problematic.

SUMMARY OF THE INVENTION

The invention is made in consideration of the above-mentioned problems of the related arts, and an advantage of the invention is to provide an image forming apparatus that is capable of adjusting overlapping portions of LED heads with a high precision so as not to cause black or white streaks, and at the same time, infinitesimally adjusting the printing magnification so as to reduce the dimensional errors of the images to be formed.

In order to achieve the above-mentioned advantage, one aspect of the invention provides an image forming apparatus capable of forming wide images. The image forming apparatus includes an exposing unit having a plurality of LED (light-emitting diode) heads arranged alternately in a main scanning direction, in which the resolution of an LED row formed in at least one of the plurality of LED heads is higher than the resolution of image data in a main scanning direction. The image forming apparatus further includes a lighting control unit that controls to turn on or turn off dots in the LED row such that the exposing position of a photoconductive drum is moved in the unit of dots in the high resolution LED row.

Another aspect of the invention provides an image forming apparatus capable of forming wide images which includes an exposing unit having a plurality of LED (light-emitting diode) heads arranged alternately in a main scanning direction, in which the resolution of an LED row formed in at least one of the plurality of LED heads is higher than the resolution of image data in a main scanning direction. The image forming apparatus further includes a lighting control unit that controls to turn on or turn off dots in the LED row such that the exposing width of a photoconductive drum is increased or decreased in the unit of dots of the high resolution LED row.

Another aspect of the invention provides an image forming apparatus capable of forming wide images which includes an exposing unit having a plurality of LED (light-emitting diode) heads arranged alternately in a main scanning direction, in which the resolution of an LED row formed in at least one of the plurality of LED heads is higher than the resolution of image data in the main scanning direction. The image forming apparatus further includes a lighting control unit that controls the on/off of dots in the LED row so that the exposing width of a photoconductive drum is increased/decreased in the unit of dots of the high resolution LED row.

BRIEF DESCRIPTION OF THE DRAWINGS

These and other objects and advantages of this invention will become more fully apparent from the following detailed description taken with the accompanying drawings in which.

DETAILED DESCRIPTION OF THE EMBODIMENTS

Hereinafter, the best mode for carrying out the present invention (hereinafter, referred to as an embodiment) will be described with reference to drawings.

Figure 1:
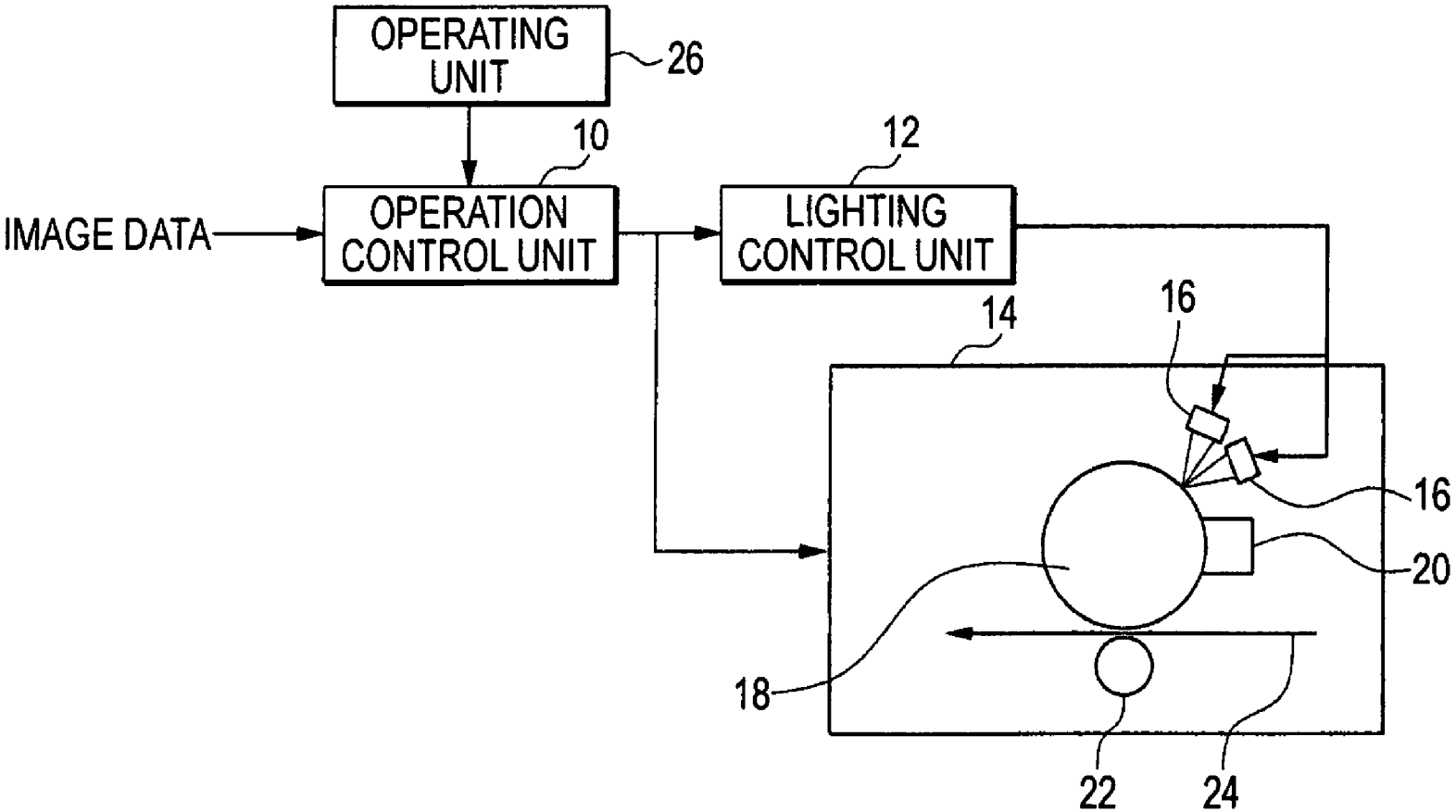
FIG. 1 is a block diagram showing an image forming apparatus of one embodiment according to the invention.

FIG. 1 is a block diagram showing an image forming apparatus of one embodiment according to the invention. In FIG. 1, the image forming apparatus includes an operation control unit 10, a lighting control unit 12, an image forming unit 14, LED heads 16, and an operating unit 26.

The operation control unit 10 obtains image data from a scanner or other computers, etc., and instructs the lighting control unit 12, etc., to control the image forming operations of the image forming apparatus according to the obtained image data.

The lighting control unit 12 controls on/off of each of the light-emitting diodes in an LED row formed in each of the LED heads 16.

The image forming unit 14 includes a photoconductive drum 18, a developing unit 20, a transfer roll 22, or the like in addition to the LED heads 16, and forms the image data as images on predetermined paper 24.

The LED heads 16 are included in the image forming unit 14, and radiates light for exposing the photoconductive drum 18 from the LED row in which the light-emitting diodes are arranged in a line. The light is collected by a condenser lens, and the condensing spot is formed on a surface of the photoconductive drum 18.

The operating unit 26 includes a keyboard, a touch panel, etc. A manipulator inputs instruction information which is necessary for control operations performed by the operation control unit 10.

Figure 2:
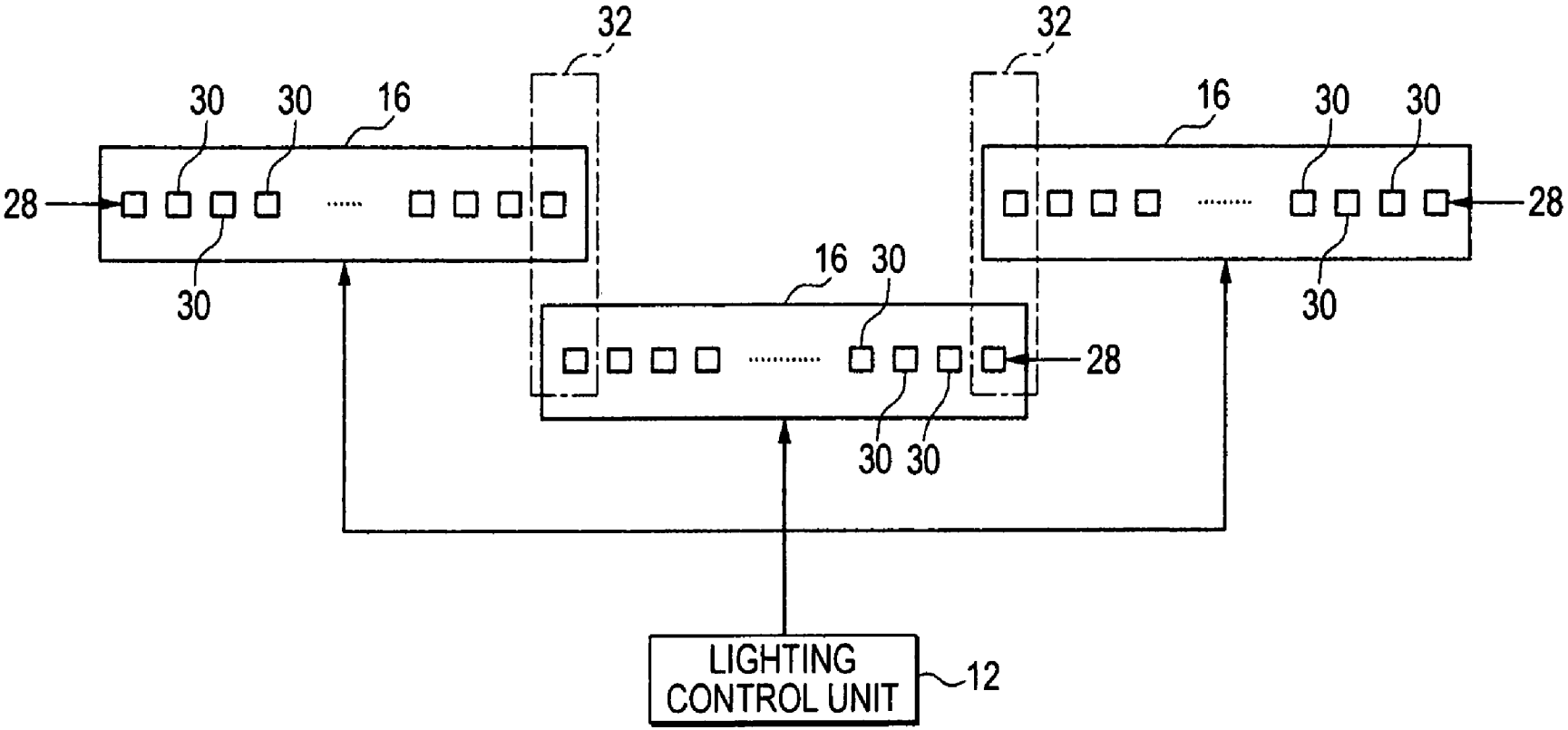
FIG. 2 is a view showing a method of arranging LED heads.

FIG. 2 shows a method of arranging the LED heads 16. In an embodiment shown in FIG. 2, three LED heads 16 are arranged alternately in a main scanning direction. That is, the three LED heads 16 are arranged while being offset each other. Each of the LED heads 16 includes LED rows 28 in which predetermined number of light-emitting diodes (hereinafter, referred to as dots) 30 are formed in a line. Each of the LED rows 28 is parallel to the main scanning direction. Here, the main scanning direction is perpendicular to a conveying direction of the paper 24. In FIG. 2, three LED heads 16 are displayed but the invention is not limited thereto. The invention may be applied to any image forming apparatus that is capable of forming wide images by a plurality of LED heads 16.

In each of the LED heads 16 used in the invention, the resolution of the LED row 28 such as the number of dots 30 per unit length is set to be higher than the resolution of the image data in the main scanning direction. For example, LED rows 28 having 1200 dpi resolution may be used in an image forming apparatus that forms image data with 600 dpi resolutions. In such case, one pixel is exposed by two dots 30.

Thus, if the LED heads 16 with a high resolution are used, the size of each of the dots 30 becomes smaller than the size of the pixels forming the image. Therefore, even when the dots in the overlapping portion 32 between the LED heads 16 are deviated in the main scanning direction, an adjustment with a high precision is available, and it is possible to restrain generation of the black or white streaks on the images.

Figure 3B:
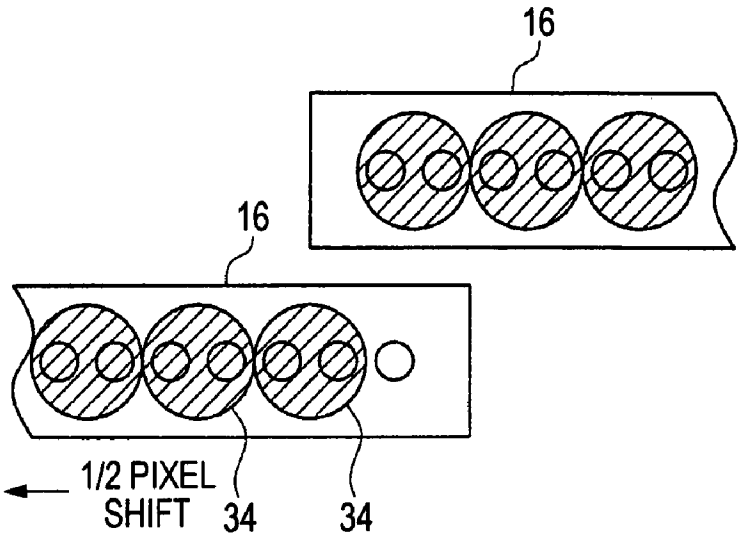
FIGS. 3A and 3B are schematic views showing a method of eliminating black streaks when an LED head arrangement is deviated in a main scanning direction.
Figure 3A:
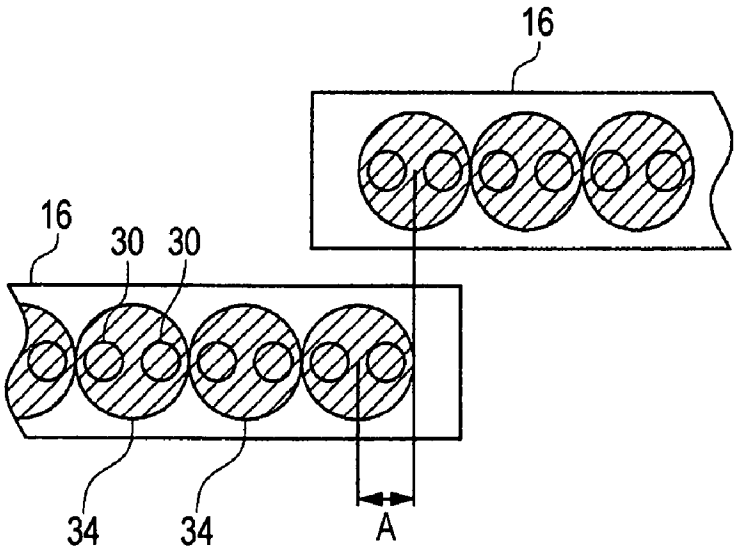

FIGS. 3A and 3B are schematic views showing a method of eliminating black streaks when the overlapping portions 32 are deviated each other and thus pixels 34 are overlapped. Also, in this embodiment, the resolution of the LED heads 16 becomes double of the resolution of the image data in the main scanning direction, and one pixel 34 is exposed by two dots 30 on the surface of the photoconductive drum 18.

In FIG. 3A, the two LED heads 16 are deviated as an infinitesimal distance A (about ½ pixel) in a direction in which they are overlapped each other and the pixels are overlapped each other by ½ pixel. In such case, as shown in FIG. 3B, the lighting control unit 12 controls one dot ½ pixel) of the dots 30 at one end of the LED head 16 to be shifted so as to expose each of pixels 34. Also, the shift control by the lighting control unit 12 is performed on the basis of a control parameter inputted by the manipulator from the operating unit 26. In addition, at this time, when only one resolution of at least one of the plurality of LED heads 16 is double of the resolution of the image data in the main scanning direction, the dot 30 in the high resolution LED head 16 is controlled to be shifted.

Thus, if the lighting control unit 12 moves the exposing position of the photoconductive drum 18 in a unit of the dot 30, the deviation in the LED heads 16 can be infinitesimally adjusted in a small unit ½ pixel). If LED heads 16 having the same resolution as the resolution of the image data in the main scanning direction is used, one pixel is exposed by one dot. Therefore, in order to eliminate the overlap of the dots 30, the exposing position should be shifted by one dot, or by one pixel. Accordingly, the distance of shift becomes larger, and a gap of about ½ pixel may be generated between the dots 30 at the overlapping portion 32. In such case, while black streaks can be eliminated, white streaks may be generated, and thus the problem does not be solved. In this embodiment, as described above, the deviation can be adjusted in a small unit ½ pixel). Consequently, it does not need to shift a large number of dots 30, and thus, it is possible to prevent white streaks from being generated after the black streaks are eliminated.

Figure 4B:
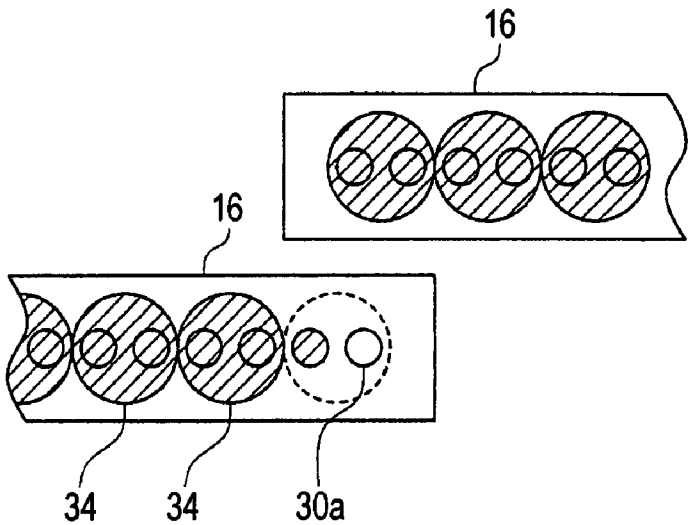
FIGS. 4A and 4B are schematic views showing a modified example of the method of eliminating black streaks when an LED head arrangement is deviated in a main scanning direction.
Figure 4A:
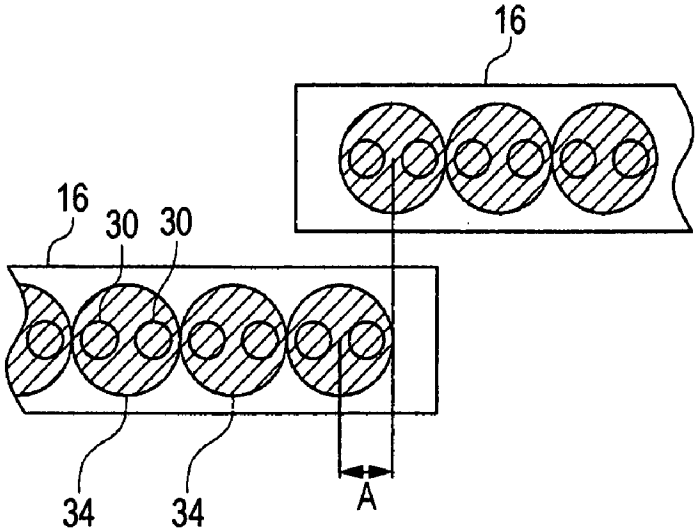

FIGS. 4A and 4B are schematic views showing a modified embodiment of the method of eliminating black streaks when the overlapping portions 32 are deviated in the main scanning direction and thus the pixels 34 are overlapped each other. Also, in this modified embodiment, the resolution of the LED heads 16 becomes double of the resolution of the image data in a main scanning direction, and thus one pixel 34 on a surface of the photoconductive drum 18 is exposed by two dots 30. In addition, in this modified embodiment, as shown in FIG. 4A, two LED heads 16 are deviated by the infinitesimal distance A (about ½ pixel) in an overlapping direction of each other and the pixels are overlapped each other by ½ pixel.

In the above-described case, as shown in FIG. 4B, the lighting control unit 12 controls the dots 30*a* at one end of the LED head 16 to be turned off. Also, the lighting control unit 12 controls the shift operation based on the control parameter inputted by the manipulator from the operating unit 26. At this time, if only one resolution of the adjacent LED heads 16 becomes double of the resolution of the image data in the main scanning direction, the dot 30*a* in the high resolution LED head 16 is controlled to be turned off.

According to the modified embodiment, since the deviation can be adjusted in a small unit ½ pixel), the black streaks can be eliminated without generating white streaks.

Figure 5B:
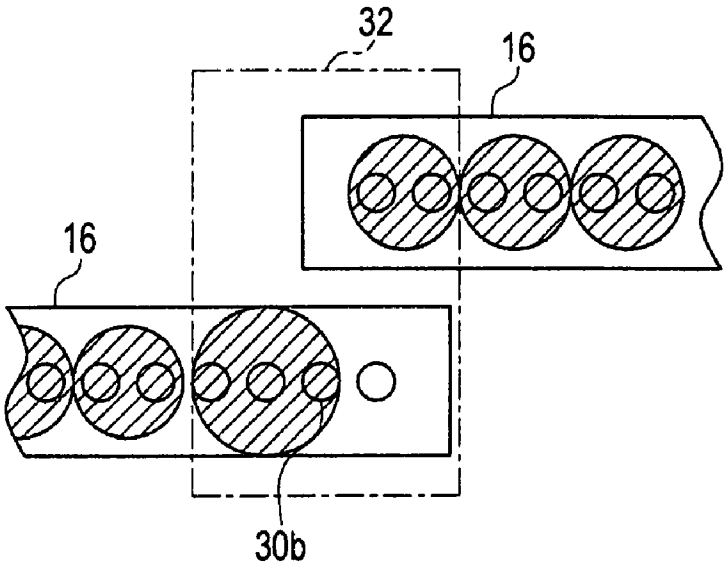
FIGS. 5A and 5B are schematic views showing a method of eliminating white streaks when an LED head arrangement is deviated in a main scanning direction.
Figure 5A:
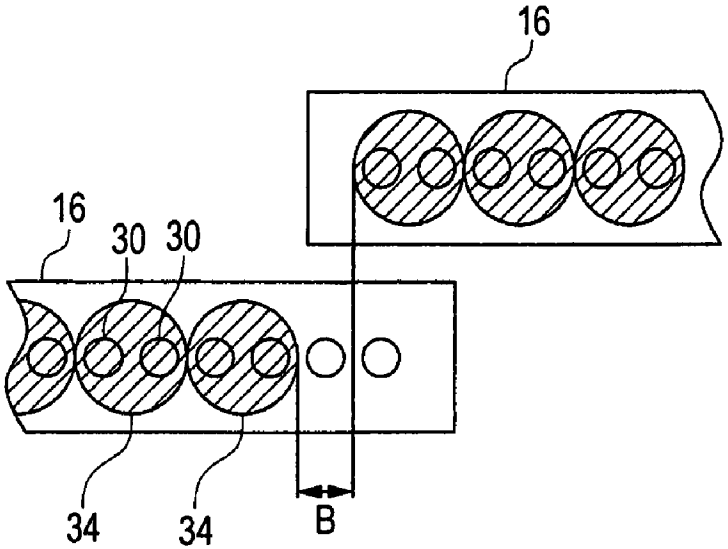

FIGS. 5A and 5B are schematic views showing a method of eliminating white streaks when the LED heads 16 are deviated from each other in a main scanning direction and thus gaps of about ½ pixel is generated between the dots 30 in the overlapping portions 32. In addition, in this embodiment, the resolution of the LED heads 16 becomes double of the resolution of the image data in the main scanning direction, and one pixel 34 is exposed by two dots 30 on the surface of the photoconductive drum 18.

In FIG. 5A, two LED heads 16 are deviated by about ½ pixel in a direction that the heads are separated from each other, and a gap having a distance B is generated between the pixels. In such case, as shown in FIG. 5B, the lighting control unit 12 turns on the dot 30*b* included in the overlapping portion 32 of one side of the LED heads 16, and controls the pixel located at one end of the LED head 16 such that the pixel is exposed by the three dots 30. Thus, white streaks corresponding to one dot can be eliminated. Accordingly, the lighting control unit 12 controls the lighting operation based on control parameters inputted by the manipulator from the operating unit 26. At this time, if only one resolution of the adjacent LED heads 16 becomes double of the resolution of the image data in the main scanning direction, the dot 30*b* in the high resolution LED head 16 is controlled to be turned off.

According to this embodiment, since the deviation can be adjusted in a small unit ½ pixel), white streaks can be eliminated after the adjustment without black streaks caused by overlapping the pixels.

Figure 6A:
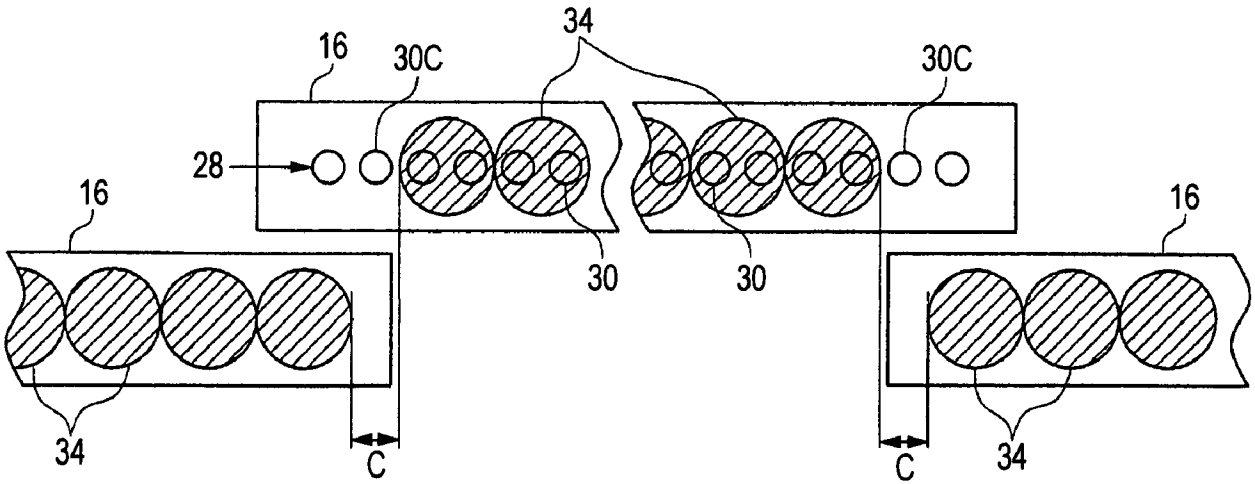
FIGS. 6A and 6B are schematic views showing another method of eliminating white streaks and infinitesimally adjusting the printing magnification when an LED head arrangement is deviated in a main scanning direction.
Figure 6B:
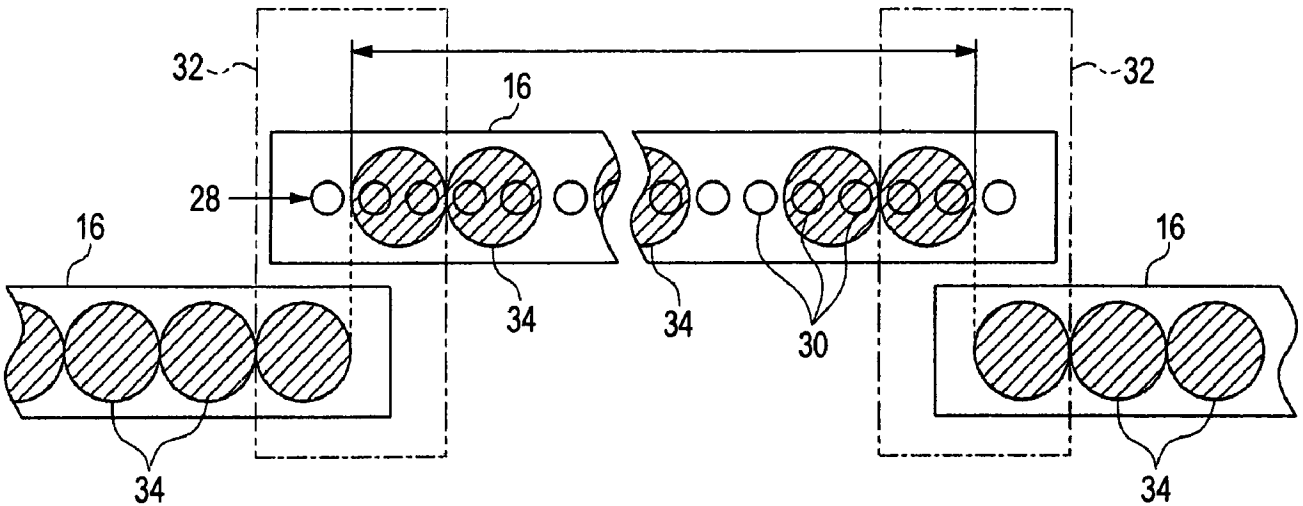

FIGS. 6A and 6B are views showing a modified embodiment of the method of eliminating white streaks generated by the deviation at the overlapping portions 32 in the main scanning direction. In addition, in FIGS. 6A and 6B, only the resolution of one of the adjacent LED heads 16 becomes double of the resolution of the image data in a main scanning direction, and one pixel 34 is exposed by two dots 30 on the surface of the photoconductive drum 18. However, the invention is not limited thereto, and the resolution of the entire LED heads 16 may be double of the resolution of the image data in the main scanning direction.

In FIG. 6A, the LED heads 16 having the double resolution of the image data and another LED heads 16 are shifted by ½ pixel in a direction that the heads are separated from each other, and a gap with a distance C between the pixels 34 is generated by ½ pixel. Therefore, white streaks in images are made on the overlapping portions 32 of the LED heads 16.

At this time, as shown in FIG. 6B, the lighting control unit 12 turns off the dot 30 in the middle of the LED rows 28 which is formed between the LED heads 16 having the double resolution, and controls each of the pixels 34 to be shifted to one end of the LED rows 28. Thus, white streaks for one dot can be eliminated. In addition, the lighting control unit 12 controls the lighting operation based on control parameters inputted by the manipulator from the operating unit 26.

In FIG. 6B, two dots 30 (one for each dot) are turned off at locations except for the overlapping portions 32 of the LED heads 16, and a gap is generated by ½ pixel. However, the dot 30 that is turned off is not located at the overlapping portion 32 and the deviation is not broadened by thermal expansion or vibration. Accordingly, white streaks do not become conspicuous. Furthermore, the white streaks can be even less conspicuous by changing the locations of the dots 30 which are turned off for every scanning.

According to this modified embodiment, by controlling to turn on or turn off the LED head 16, the deviation of the overlapping portions at both ends can be adjusted, it is not necessary to control LED heads 16 at both ends. Therefore, elimination of white streaks can be easily controlled.

In addition, in the modified embodiment with reference to FIGS. 6A and 6B, the case that white streaks are generated is described. However, the invention is also applicable to a method of eliminating black streaks caused by overlapping the pixels 34 when pixels are deviated by ½ pixel on the LED heads 16 in a direction to which the LED heads 16 approach each other. In such case, black streaks can be eliminated by providing a portion that exposes one pixel by a single dot, rather than two dots, in the middle of the LED row 28, and controlling each of the pixels to be shifted toward the center of the LED row 28.

Furthermore, the modified embodiments of FIGS. 6A and 6B are also applicable to a method of eliminating deviation from an original dimension of formed images. In other words, when the lighting control unit 12 conducts the exposure of the pixels 34 on the LED heads 16 having a double resolution, the lighting control unit 12 turns off the dot 30 in the middle of the LED row 28 which is formed on the LED heads 16, and controls each of the pixels to be shifted to the end of the LED row 28. Thus, the exposing width of the photoconductive drum 18 can be increased with the dot 30 as a unit. Furthermore, conversely, by providing a portion that exposes one pixel with one dot, rather than two dots, in the middle of the LED row 28, and controlling each of the pixels to be shifted to the center of the LED row 28, the exposing width of the photoconductive drum 18 can be decreased with the dot 30 as a unit.

According to the structure described above, when the dimension of an object on a screen is smaller or larger than the original dimension, the printing magnification can be infinitesimally adjusted by shifting the pixels according to the above-mentioned control operation, and the images to be formed can be matched to the original dimension.

Also, the shift control by the lighting control unit 12 is performed based on the control parameter inputted by the manipulator from the operating unit 20. Furthermore, at this time, if only at least one resolution of the plurality of LED heads 16 becomes double of the resolution of the image data in the main scanning direction, the pixel 34 on the high resolution LED head 16 is controlled to be shifted.

Although various embodiments have been described with regard to the LED heads which are typical image bars hereinbefore, the invention is not limited thereto, and other types of image bars may also be implemented in the invention.

What is claimed is:

1. An image forming apparatus capable of forming wide images, comprising:

an exposing unit having a plurality of LED heads wherein longitudinal directions of the respective LED heads are parallel to a main scanning direction, adjacent LED heads partially overlap each other in a direction perpendicular to the main scanning direction, a resolution of an LED row formed in at least one of the plurality of LED heads is higher than that of image data in the main scanning direction; and a lighting control unit that controls to turn on or turn off dots in the LED row such that an exposed position of a photoconductive drum is moved in units of a dot of the LED row;

wherein a plurality of the dots in the LED row are used to form a single image pixel;

wherein when a white streak occurs, the lighting control unit controls to turn off a dot in a middle of the LED and to correspondingly shift each pixel in the LED row toward end portions of the LED row, and when a black streak occurs, the lighting control unit controls to provide, in a middle of the LED row, a portion that exposes one pixel by dots which are less in number than dots in another LED row to expose one pixel and to correspondingly shift each pixel toward a center of the LED row.

2. The image forming apparatus according to claim 1, wherein one dot formed an end of the one of the plurality of LED heads overlaps another dot formed at an end of the other of the plurality of LED heads.

3. A method of forming wide images, comprising:

providing the image forming apparatus of claim 1, using the lighting control unit to turn on or turn off dots in the LED row such that the exposed width of the photoconductive drum is increased or decreased in units of the dot of the LED row, and forming the single image pixel using the plurality of the dots in the LED row such that the resolution of the LED row formed in the at least one of the plurality of LED heads is higher than that of the image data in the main scanning direction.

4. The image forming apparatus of claim 1, wherein the adjacent LED heads are deviated by about ½ pixel in an overlapping direction with respect to one another.

5. An image forming apparatus capable of forming wide images, comprising:

an exposing unit having a plurality of LED heads wherein longitudinal directions of the respective LED heads are parallel to a main scanning direction, adjacent LED heads partially overlap each other in a direction perpendicular to the main scanning direction, a resolution of an LED row formed in at least one of the plurality of LED heads is higher than that of image data in the main scanning direction; and a lighting control unit that controls the number of dots that are turned on in the higher resolution LED row at an overlapping portion between the plurality of LED heads;

wherein a plurality of the dots in the LED row are used to form a single image pixel;

wherein when a white streak occurs, the lighting control unit controls to turn off a dot in a middle of the LED and to correspondingly shift each pixel in the LED row toward end potions of the LED row, and when a black streak occurs, the lighting control unit controls to provide, in a middle of the LED row, a portion that exposes one pixel by dots which are less in number than dots in another LED row to expose one pixel and to correspondingly shift each pixel toward a center of the LED row.

6. The image forming apparatus according to claim 5, wherein one dot formed an end of the one of the plurality of LED heads overlaps another dot formed at an end of the other of the plurality of LED heads.

7. A method of forming wide images, comprising:

providing the image forming apparatus of claim 5, using the lighting control unit to turn on or turn off dots in the LED row such that the exposed width of the photoconductive drum is increased or decreased in units of the dot of the LED row, and forming the single image pixel using the plurality of the dots in the LED row such that the resolution of the LED row formed in the at least one of the plurality of LED heads is higher than that of the image data in the main scanning direction.

8. The image forming apparatus of claim 5, wherein the adjacent LED heads are deviated by about ½ pixel in an overlapping direction with respect to one another.

9. An image forming apparatus capable of forming wide images, comprising:

an exposing unit having a plurality of LED heads, wherein longitudinal directions of the respective LED heads are parallel to a main scanning direction, adjacent LED heads partially overlap each other in a direction perpendicular to the main scanning direction, a resolution of an LED row formed in at least one of the plurality of LED heads is higher than that of image data in the main scanning direction; and a lighting control unit that controls to turn on or turn off dots in the LED row such that an exposed width of a photoconductive drum is increased or decreased in units of a dot of the LED row;

wherein a plurality of the dots in the LED row are used to form a single image pixel;

wherein when a white streak occurs, the lighting control unt controls to turn off a dot in a middle of the LED and to correspondingly shift each pixel in the LED row toward end potions of the LED row, and when a black streak occurs, the lighting control unit controls to provide, in a middle of the LED row, a portion that exposes one pixel by dots which are less in number than dots in another LED row to expose one pixel and to correspondingly shift each pixel toward a center of the LED row.

10. The image forming apparatus according to claim 9, wherein one dot formed an end of the one of the plurality of LED heads overlaps another dot formed at an end of the other of the plurality of LED heads.

11. A method of forming wide images, comprising:

providing the image forming apparatus of claim 9, using the lighting control unit to control the number of dots that are turned on in the higher resolution LED row at the overlapping portion between the plurality of LED heads, and forming the single image pixel using the plurality of the dots in the LED row such that the resolution of the LED row formed in the at least one of the plurality of LED heads is higher than that of the image data in the main scanning direction.

12. The image forming apparatus of claim 9, wherein the adjacent LED heads are deviated by about ½ pixel in an overlapping direction with respect to one another.

* * * * *